United States Patent [19]

Cline

[11] Patent Number: 4,612,161

[45] Date of Patent: Sep. 16, 1986

[54] FABRICATION OF METALLIC GLASS STRUCTURES

[75] Inventor: Carl F. Cline, Walnut Creek, Calif.

[73] Assignee: The United States of America as represented by the United States Department of Energy, Washington, D.C.

[21] Appl. No.: 543,686

[22] Filed: Oct. 20, 1983

[51] Int. Cl.[4] ..... B22F 3/08

[52] U.S. Cl. ..... 419/3; 419/5; 419/12; 419/51; 419/66

[58] Field of Search ..... 419/12, 29, 38, 48, 419/66, 51, 3, 5

[56] References Cited

U.S. PATENT DOCUMENTS

| | | | |
|---|---|---|---|
| 3,022,544 | 2/1962 | Coursen et al. | 419/38 |
| 3,856,513 | 12/1974 | Chen et al. | 75/122 |
| 4,116,682 | 9/1978 | Polk et al. | 75/123 H |
| 4,325,895 | 4/1982 | Morris | 419/38 |
| 4,381,197 | 4/1983 | Liebermann | 419/29 |
| 4,490,329 | 12/1984 | Hare et al. | 419/51 |

OTHER PUBLICATIONS

Predecki et al., *Transactions of the Metallurgical Society of AIME,* vol. 233, p. 1581, 1965.

Ruhl, *Materials Science and Engineering,* No. 1, p. 313, 1967.

Duwez et al., *Transactions of the Metallurgical Society of AIME,* vol. 227, p. 362, 1963.

Pietrokowsky, *The Review of Scientific Instruments,* vol. 34, p. 445, 1963.

Pond, Jr. et al., *Transactions of the Metallurgical Society of AIME,* vol. 245, p. 2475, 1969.

Chen et al., *The Review of Scientific Instruments,* vol. 41, p. 1237, 1970.

Cline et al., *Scripta Metallurgica,* vol. 11, No. 12, pp. 1137–1138, 1977.

Lawrence Livermore National Laboratory Article, *Energy and Technology Review,* Oct. 1977, pp. 11 and 111.

Cline et al., "Explosive Fabrication of Rapidly Solidified Alloys", Proceedings of the Conferences on Rapid Solidification Process: Principles and Technologies, Reston, Va., Nov. 13–16, 1977.

Patterson et al., *Mat. Res. Bull.,* vol. 13, pp. 583–585, 1978.

*Primary Examiner*—Allan M. Lieberman

*Attorney, Agent, or Firm*—John F. Schipper; L. E. Carnahan; Judson R. Hightower

[57] ABSTRACT

Amorphous metal powders or ribbons are fabricated into solid shapes of appreciable thickness by the application of compaction energy. The temperature regime wherein the amorphous metal deforms by viscous flow is measured. The metal powders or ribbons are compacted within the temperature range.

3 Claims, No Drawings

FABRICATION OF METALLIC GLASS STRUCTURES

The U.S. Government has rights in this invention pursuant to Contract No. W-7405-ENG-48 between the U.S. Department of Energy and the University of California.

BACKGROUND OF THE INVENTION

The present invention relates in general to the art of metallurgy, and more particularly to a method of fabricating structures of metallic glass.

Metallic glasses constitute a new class of materials whose amorphous structure produces excellent strength, hardness, ductility, corrosion resistance, wear properties, radiation stability, and isotropic mechanical behavior. Each of these glasses consists of a molten (or vaporized) alloy that has been chilled so abruptly (about $10^6$ °K. per second) that it had no time to form crystals. The result is a homogeneous material completely free of the inclusions, dislocations, and grain boundaries that characterize ordinary metal specimens.

Amorphous metals are commercially available only in shapes having maximum surface area per unit mass of material, e.g., ribbons, sheets, wires, and powders. This is because rapid quenching from the melt can only be accomplished with a geometry that provides maximum heat transfer per unit mass of material.

Various procedures have been developed for providing rapid quenching by spreading the molten alloy in a thin layer against a metal substrate held at, or below, room temperature. The molten alloy is typically spread to a thickness of about 0.05 mm, which leads to a cooling rate of about $10^6$ °C./sec. Details of the quenching process are given by R. Predecki, et al, in *Trans. AIME* 233, 1581 (1965), and also by R. C. Ruhl in *Mat. Sci. & Eng.*, 1, 313 (1967). P. Duwez and R. H. Willens describe in *Trans. AIME* 227, 362 (1963) a gun technique in which a gaseous shock wave propels a drop of molten alloy against a copper substrate, the so-called "splat cooling" method. In *Rev. Sci. Instr.* 34, 445 (1963), P. Pietrokowsky describes a piston and anvil technique in which two metal plates come together rapidly to flatten and quench a drop of molten alloy falling between them. Ribbons or foils of amorphous metal can be produced by the casting technique described by R. Pond, Jr. and R. Maddin in Trans. *Met. Soc. AIME* 245, 2475 (1969) in which a molten metal stream impinges on the inner surface of a rapidly rotating hollow cylinder open at one end. Similarly, H. S. Chen and C. E. Miller describe in *Rev. Sci. Inst.* 41, 1237 (1970) a double rolls technique in which molten metal is squirted into the nip of a pair of rapidly rotating rollers.

The fact that amorphous metals are available only in thin ribbons or strips severely limits their practical utility. Commercial use would be much more widespread if these materials could be manufactured in standard structural shapes of appreciable thickness. Prior attempts to fabricate three-dimensional shapes have been unsuccessful, or only partially successful. The amorphous alloy may immediately crystallize during processing, and lose its desirable physical properties. The reason for this behavior is that the processing is carried out in a time-temperature regime that falls within the crystallization region for the alloy. Other attempts have shown that larger size pieces can be produced, but a process for reliably producing such larger size pieces while maintaining the desired properties has not been described.

The article, "Explosive Fabrication of Metallic Glasses", in Energy and Technology Review, October 1977, pp. ii and iii, indicated that a solid rod of metallic glass had been produced at the Lawrence Livermore Laboratory, Livermore, Calif., by packing powder into a steel pipe, immersing it in a liquid explosive, and detonating the explosive at one end of the pipe. This work was also reported in the following publications:

(1) C. F. Cline and R. W. Hopper, "Explosive Fabrication of Rapidly Quenched Materials", *Scripta Metallurgica,* Vol. 11, No. 12, pp. 1137–1138, 1977.

(2) C. F. Cline, J. Mahler, M. Finger, W. Kuhl, and R. W. Hopper, "Explosive Fabrication of Rapidly Solidified Alloys", Proceedings of the Conference on "Rapid Solidification Processing: Principles and Technologies," Reston, Va., Nov. 13–16, 1977.

The article, "Moulding of a Metallic Glass," in Mat. Res. Bull., Vol. 13, pp. 583–585, 1978, indicates that explosive forming has been explored in connection with amorphous metals and alloys. An amorphous alloy was pressed into a moulding at 390° C. for up to one minute, and was still in an amorphous condition on the scale of a transmission electron microscope.

In U.S. Pat. No. 3,856,513 to Ho-Sou Chen, et al, patented Dec. 24, 1974, amorphous metals and amorphous metal articles are described. The compositions are quenched from the melt to the amorphous state. By the addition of certain elements, the alloys become better transformers, i.e., the amorphous state is more readily obtained, and is more thermally stable.

In U.S. Pat. No. 4,116,682 to D. E. Polk, patented Sept. 26, 1978, products of amorphous metal are described. The products may include cutting tools, such as razor blades. The alloys are rich in iron, nickel, cobalt, chromium, and/or manganese. The alloys contain at least one element from each of the three groups of elements, and are low in metalloids compared to previously known, liquid-quenched, amorphous alloys. A class of amorphous metal compositions are describe which are readily quenched to the amorphous state, in which they display improved physical characteristics. The class of compositions is defined by the formula $N_aT_bX_c$, where N is any combination of elements from the group consisting of iron, nickel, cobalt, chromium, and manganese; T is any combination of elements from the group consisting of zirconium, tantalum, niobium, molybdenum, tungsten, yttrium, titanium, and vanadium; and X is any combination of elements in the group consisting of boron, silicon, phosphorous, carbon, germanium, and arsenic.

In U.S. Pat. No. 3,022,544 to D. L. Coursen, et al, patented Feb. 27, 1962, the explosive compaction of powders is described. A tubular container is surrounded by a mass of powder, with a layer of high velocity detonating explosive. The explosive layer has a substantially continuous and uniform composition. A detonating explosive having a conical configuration is positioned with the base of the cone adjacent to one edge of said layer of explosive. The conical explosive is initiated at its apex to form a compact by compressing the powder within the container.

Some experimentation has been reported indicating that larger size pieces can be produced by pressing metallic glass powder into larger size pieces. Such pressing operations, if not properly performed, could destroy the desirable properties of the metallic glass material and result in the larger size pieces lacking the desirable properties or with the desirable properties being reduced. A process that would produce larger size pieces and insure that the larger size pieces retain the desirable properties of the metallic glass would be a significant advancement of the art.

SUMMARY

An object of the invention is to provide finished units of metallic glass of substantial size, density, and strength, while preserving the desirable characteristics of the original amorphous material.

Another object of the invention is to provide finished units of metallic glass of varying shapes, while preserving the desirable amorphous material characteristics.

A further object of the invention is to provide a method for producing metallic glass of varying shapes and sizes without causing the metallic glass to become brittle.

Additional objects, advantages and novel features of the invention will be set forth in part in the description which follows, and in part will become apparent to those skilled in the art upon examination of the following, or may be learned by practice of the invention. The objects and advantages of the invention may be realized and attained my means of the instrumentalities and combinations particularly pointed out in the appended claims.

To achieve the foregoing and other objects, and in accordance with the purpose of the present invention, as embodied and broadly described herein, the process of this invention may comprise determining the temperature range wherein an amorphous material is deformed to a viscous flow. The amorphous material is then disposed in a compaction position, and compacted under conditions wherein the temperature is within the viscous flow temperature range previously determined, but below the long time crystallization temperature of the amorphous material.

Metallic glasses produced by prior art methods are available only in thin ribbons or strips, which limits their utility. The availability of metallic glasses having different shapes and sizes, as defined by the present invention, expands the possible applications of such materials.

DETAILED DESCRIPTION OF THE INVENTION

Reference will now be made in detail to the present preferred embodiment of the invention, an example of which is set out in the following description.

Amorphous metals, also known as glassy metals or metallic glasses, are a class of materials produced by quenching molten alloys at such a rapid rate that crystallization does not occur. Typical cooling rates are on the order of $10^6$ °C./sec. These materials are of practical interest because of their unusual physical properties: very high strength; high corrosion and wear resistance; radiation stability; coupled with moderate ductility. A variety of amorphous metals are marketed by Allied Chemical Company under the trademark "Metglas".

The method of the present invention produces larger size pieces having the desirable properties of metallic glass.

A sample of the make-up metallic glass material is subjected to a standard hot hardness test. In one embodiment, a ribbon of the metallic glass material is placed in a hot hardness test machine (or other suitable apparatus), the temperature is increased, and a record is produced of the hardness changes as a function of temperature. This record shows the long time crystallization temperature and the threshold temperature at which the material plastically deforms.

The make-up metallic glass material is then compacted under conditions that keep the material below the long time crystallization temperature, and above the threshold temperature at which the material plastically deforms. This temperature T is defined as follows:

$$T = \frac{0.17D^2}{C}\left(\frac{\sqrt{1.185\,\alpha - 1} - 1}{\sqrt{1.185\,\alpha + 1} + 1}\right)^2 \quad (1)$$

where

T is the maximum overall uniform temperature;

D is the detonation velocity of the explosive charge;

$\alpha$ is the ratio of active mass of explosive charge to active mass of the compacting material (amorphous material); and C is the specific heat of the compacting material.

This allows the material to achieve the desired density, yer maintain the desirable amorphous characteristics of the material.

The material is explosively compacted, with the type and amount of explosive chosen so that the compaction takes place at the aforementioned temperature or the compaction is accomplished by other compaction means.

Thus, for any given compacting material, the threshold temperature at which it plastically deforms is dependent on the kind of explosive as well as the amount, and the kind and amount of compacting material. These parameters can vary for any given compaction process, and thus the threshold temperature at which the amorphous material deforms will also vary.

Once the larger size piece is produced by compaction, it can be machined into the shape of the desired part or piece. Alternatively, the part or piece can be formed in the desired shape directly.

It has also been discovered that certain amorphous materials such as $Fe_{40}Ni_{40}P_{14}B_6$ may become subject to embrittlement under various time and temperature conditions, even though the long time crystallization temperature is not reached. To overcome this possibility, samples of the make-up metallic glass material are tested for brittleness under a range of time and temperature conditions. This is accomplished by heating different samples according to a range of time and temperature conditions within the aforementioned preferred conditions, wherein the metallic glass material is caused to deform. The samples are subsequently tested for brittleness by bending a ribbon of the material over a flat surface such as a razor blade. The conditions that produce the brittleness are then avoided in the compaction operation.

In order to more fully understand the present invention, the following examples of the production of larger size pieces of metallic glass from a powder of metallic glass material are described. It is to be understood that these examples are by no means meant to limit or restrict the invention, but are provided for illustration purposes only.

EXAMPLE 1

This example illustrates the production of a 15 cm long×0.6 cm diameter rod by the compaction of $Ni_{40}Fe_{40}P_{14}B_6$ metallic glass powder.

A sample of the make-up metallic glass powder was first subjected to a standard hot hardness test. The metallic glass powder was placed in a hot hardness test machine, the temperature was increased incrementally, and a record was produced of hardness changes as a function of temperature.

The metallic glass powder was then compacted under conditions that maintained the material below the long time crystallization temperature and at or above the threshold temperature at which the material plastically deforms. This temperature was 352° C. Compaction under these conditions allowed the material to achieve the desired density, yet maintain the desirable amorphous characteristics of the material. The powder was explosively compacted, with the type and amount of explosive chosen so that the compaction occurred at the aforementioned temperature.

To carry out the compaction operation, the powder (21.7 grams) was packed into a 10 cm×0.95 cm inner diameter steel pipe and the pipe was surrounded by PETN explosive. The explosive was detonated at one end of the pipe to produce the 15 cm long×0.6 cm diameter rod of metallic glass material.

EXAMPLE 2

This example illustrates the production of a 0.71 cm diameter rod by the compaction of $Pd_{77.5}Cu_6Si_{16.5}$ metallic glass powder.

A sample of the make-up metallic glass powder was first subjected to a standard hot hardness test. The metallic glass powder was placed in a hot hardness test machine, the temperature was increased, and a record of hardness changes as a function of temperature was produced.

Metallic glass powder was then compacted under conditions which maintained the material below the long time crystallization temperature and at above the threshold temperature at which the material plastically deforms. This allowed the material to achieve the desired density, yet maintain the desirable amorphous characteristics of the material. The powder was explosively compacted, with the type and amount of explosive chosen so that the compaction took place at a temperature of 350° C. without exceeding the long term crystallization temperature.

The powder (48 grams) was packed into a 21.7 cm×0.95 cm inner diameter steel pipe, and the pipe surrounded by PETN explosive. The explosive was detonated at one end of the pipe to produce the 0.71 cm diameter rod of metallic glass material.

The foregoing description of a preferred embodiment of the invention has been presented for purposes of illustration and description. It is not intended to be exhaustive or to limit the invention to the precise form disclosed; and obviously many modifications and variations are possible in light of the above teaching. The embodiment was chosen and described in order to best explain the principles of the invention and its practical applications, to thereby exable others skilled in the art to best utilize the invention in various embodiments and with various modifications as are suited to the particular use contemplated. It is intended that the scope of the invention be defined by the claims appended hereto.

I claim:

1. A process for producing a substantially cylindrical solid body of amorphous metallic glass of thickness substantially 0.6 cm or larger and arbitrary length from amorphous metallic glass material in powder or ribbon form, the method comprising the steps of:

providing a rigid metal, hollow cylinder of inside diameter substantially 130–150 percent of the desired diameter of the solid body and of length substantially equal to the desired length of the solid body;

providing sufficient amorphous metallic glass powder or ribbon in the metal hollow cylinder to substantially fill the cylinder interior;

providing a quantity of explosive contiguous to and substantially covering the exterior side wall of the metal determining the long-term crystallization temperature $T_c$ of the amorphous material, the threshold temperature $T_d$ for plastic deformation of the amorphous material, and the resulting temperature $T_r$ to which the amorphous material will rise in response to detonantion of the adjacent explosive, where $T_r$ is given approximately by $$T_r = \frac{0.17D^2}{C}\left(\frac{\sqrt{1.185\alpha - 1} - 1}{\sqrt{1.185\alpha + 1} + 1}\right)^2,$$

where D being the detonation velocity of the explosive charge, C being the specific heat of the amorphous material and $\alpha$ being the ratio of active mass of the explosive charge to the mass of the amorphous material;

detonating the explosive so that the detonation wave moves from one end of the cylinder sidewall to the other end and generates a radial, inwardly-directed force to dynamically compact the amorphous metallic glass material and to thereby convert the material to a solid body of amorphous material;

where the quantity of explosive is chosen so that the amorphous material under conditions of dynamic compaction reaches a resulting temperature $T_r$ satisfying $T_d \leqq T_r < T_c$.

2. A process according to claim 1, further including the step of providing $Fe_{40}Ni_{40}P_{14}B_6$ as the amorphous material.

3. A process according to claim 1, further including the step of providing $Pd_{77.5}Cu_6Si_{16.5}$ as the amorphous material.

* * * * *